United States Patent [19]

Burney

[11] Patent Number: 4,707,924

[45] Date of Patent: Nov. 24, 1987

[54] LOCKING HOLE PUNCH

[75] Inventor: Burrell T. Burney, DeWitt, Nebr.

[73] Assignee: Peterson Manufacturing Co., Inc.

[21] Appl. No.: 872,958

[22] Filed: Jun. 11, 1986

[51] Int. Cl.[4] ..... B26F 1/06

[52] U.S. Cl. ..... 30/363; 30/366

[58] Field of Search ..... 30/363, 364, 366; 81/371, 319, 320

[56] References Cited

U.S. PATENT DOCUMENTS

| | | | |
|---|---|---|---|
| 1,890,955 | 12/1932 | Spengler | 30/363 |
| 2,590,750 | 3/1952 | Burns | 81/371 |
| 2,783,797 | 3/1957 | Blatt | 81/319 |
| 2,937,677 | 5/1960 | McIlwain | 81/372 |
| 3,261,073 | 7/1966 | Klenk | 30/363 X |
| 3,505,714 | 4/1970 | Boileau | 30/363 X |

*Primary Examiner*—Douglas D. Watts

*Attorney, Agent, or Firm*—Lackenbach Siegel Marzullo & Aronson

[57] ABSTRACT

A locking hole punch for punching holes in metal sheets, particularly metal sheets difficult of access such as metal C-studs, is disclosed. This hole punch comprises an arm member that has a head at the end of an outwardly curved portion and a first handle extending from that curved portion. A first lever member formed in a generally mating outwardly curved configuration is pivotably connected to the arm at the top of the arm handle at a first pivot. A generally straight second lever, which acts as a second handle spaced from the arm handle, is pivotably connected to the first lever member at a second pivot near the first pivot. A toggle member is connected to the second lever at a third pivot and to the arm handle at a fourth pivot. When the arm and second handles are pressed together, the toggle member is driven so that the second, third, and fourth pivots are moved into a straightline alignment so that the punch, which includes a punching pin, is driven into a working position with the head. The toggle member can be further driven into a locked mode, which is releasable by operation of a toggle release device. The punching pin can be adjusted to various lengths from the face of the punch by a pin adjusting mechanism. The hole punch is biased from the working position to an open position.

13 Claims, 7 Drawing Figures

LOCKING HOLE PUNCH

FIELD OF THE INVENTION

This invention relates generally to punching tools and in particular to a locking hole punch for metal sheeting for punching holes in metal sheeting by hand.

BACKGROUND OF THE INVENTION

Electrical conduit that is run vertically in building studs is held in place by ties which grip the conduit to the stud through holes punched in the studs. The holes are generally punched by hand with a hammer and awl or hand-held punch. In recent years C-shaped metal studs have been used in construction with the conduit run down the channels. A pair of holes are punched in the center sheet piece at intervals and the conduit is tied to the metal studs at each set of holes. At times the conduit is held to the studs by ties that are held to the stud sheet by screws. The punched holes are often off-size, either too large or too small or incompletely punched. When screws are placed in such holes, they sometimes will not bite or hang loosely from the stud. Also, the studs can be damaged by incorrectly punched holes. In addition, electrical mounting boxes are mounted at the bottom of the studs by a number of screws. Holes for the mounting screws are also hand punched through the studs in the same manner described above with the same problems resulting.

Ordinary locking hand tools, however, are not able to extend around the stud flanges to the center of the sheet of the C-shaped studs, so that awkward two-tooled methods continue to be used in the construction industry.

A C-clamp locking hand tool is capable of approaching both sides of the center member of a C-channel with ease. Locking hand tools, however, do not have punching capabilities. A locking hand tool, on the other hand, operates on the principle of the toggle, which can be the basis for a driving capability adaptable for punching.

One patent which describes a punching tool operated by a toggle drive is described in U.S. Pat. No. 1,674,844 issued June 26, 1928 to H. Spengler, which describes a toggle that is arranged to be opened and closed in the opening and closing movements of a pair of levers provided at their free ends with hand grips. The punch is operated through the punching stroke by bringing the handles together, the toggle being opened in this operation. The punch is retracted when the handles are moved apart.

Another patent that describes a punching tool by a toggle-type drive is described in U.S. Pat. No. 1,685,604 issued Sept. 25, 1928 to J. Jensen, which describes a lever and an arm each having handles at their free ends. The lever drives a rocker lever having a punch by a toggle-type mechanism, bringing the handles together, the toggle being opened in this operation. The punch is retracted when the handles are moved apart.

Other patents which describe hand punch tools are as follows:

| Inventor | U.S. Pat. No. | Date of Issue |
|---|---|---|
| Gates | 126,141 | Apr. 30, 1872 |
| Morrill | 279,493 | June 12, 1883 |
| McGill | 351,645 | Oct. 26, 1886 |
| Avery | 387,133 | July 31, 1888 |
| Keighley | 566,402 | Aug. 25,1896 |

-continued

| Inventor | U.S. Pat. No. | Date of Issue |
|---|---|---|
| Philippi | 818,783 | Apr. 24, 1906 |
| Kidder | 834,139 | Oct. 23, 1906 |
| Goddard | 893,071 | July 14,1908 |
| Whitney | 898,397 | Sept. 8, 1908 |
| Blum | 902,643 | Nov. 3, 1908 |
| Goddard | 1,036,896 | Sept. 10, 1912 |
| Whitney | 1,065,752 | June 24, 1943 |
| Valentine | 2,359,699 | Oct. 3, 1944 |
| Klenk | 3,261,073 | July 19, 1966 |
| Hamel | 3,261,073 | Aug. 6, 1968 |
| Deike | 3,939,563 | Feb. 24, 1976 |

Certain patents which describe locking hand tools are as follows:

| Inventor | U.S. Pat. No. | Date of Issue |
|---|---|---|
| W. Petersen | 1,489,458 | Apr. 18, 1924 |
| W. Petersen | 2,201,918 | May 21, 1940 |
| W. Petersen | 2,280,005 | Apr. 14, 1942 |
| Borchers | 2,299,454 | Oct. 20, 1942 |
| Toernberg | 2,341,489 | Feb. 8, 1944 |
| W. Petersen | 2,417,013 | Mar. 4, 1947 |
| C. Petersen | 2,563,267 | Aug. 7, 1951 |
| C. Petersen | 2,590,031 | Mar. 18, 1952 |
| W. Petersen | 2,711,663 | June 28, 1955 |
| W. Petersen | 2,853,910 | Sept. 30, 1958 |
| Hostetter | Re. 26,280 | Jan. 7, 1964/ Oct. 17, 1967 |
| C. Petersen et al | 3,192,804 | July 6, 1965 |
| Schroeder | 3,585,704 | June 22, 1971 |
| Marasco | 3,590,669 | July 6, 1971 |
| Baldwin | 3,600,986 | Aug. 24, 1971 |
| C. Petersen | 4,541,312 | Sept. 17, 1985 |
| C. Petersen | 4,546,680 | Oct. 15, 1985 |

It is the object of this invention to provide a C-clamp locking hand tool with punching capability that can be used to punch holes in sheet metal difficult to access.

It is another object of this invention to provide a C-clamp locking hand tool with opposed mounts for punching holes in the main sheet of a C-shaped metal stud.

It is another object of this invention to provide a hand tool which is capable of quickly and easily punching holes in a metal stud with one hand.

SUMMARY OF THE INVENTION

Accordingly, in order to meet the above objects, as well as others that will become apparent hereafter, a hand tool for punching holes through the metal sheet of a C-shaped stud is provided. The system includes an arm having a head member at one end and a handle at the other end and an outwardly curved, preferably C-shaped, portion between the head member and the handle portion; a first lever member outwardly curved, preferably C-shaped, in configuration and having a punch means at one end and pivotably mounted at the other end to the arm member at a first pivot between the handle portion and the outwardly curved portion, the first lever member and the arm member being pivotably movable about the first pivot between open and working closed positions, so that in the open position the punch means is spaced from the head member, and in the working position the punch means is in operative relationship with the head member. Also, the outwardly curved portion and an outwardly curved second lever member form a closed aperture. The punch member and the head member are for punching a hole in the sheet when the sheet is positioned between the punch member and the head; a second lever member having a pivot end pivotably mounted to the first lever member at a second pivot spaced from the first pivot and an opposed handle end, the second lever member being spaced from the handle portion in the open position and being adapted to be hand held together with the handle portion of the arm member. Also provided is a toggle member pivotably mounted to the second lever member at a third pivot and to the handle portion of the arm member at a fourth pivot, the second lever member being adapted to lever the first lever member at the second pivot about the third pivot from the open position to the working position in response to pressure moving the handle portion and the second lever member from the open position to the working position. The toggle member is adapted to be aligned along the third and fourth pivots as well as the second pivot when the first lever member is in the working (closed) position. A biasing spring connects the handle portion to the first lever member for returning the first lever member with the second lever member from the closed working position to the open position.

The tool can be driven to a power line wherein the second, third, and fourth pivots are aligned and the first lever is driven to a maximum position with the punch member also at its minimum distance from the head member.

A toggle adjusting device positioned on the handle portion of the arm is capable of moving the location of the fourth pivot to a plurality of selected positions along the handle portion relative to the first pivot. This capability allows the power line to be shifted and gives the system the capability of adjusting the distance between the head and the punch to a plurality of thicknesses of possible sheets to be punched.

The punch member includes a punching pin that is adapted to be received by a bore in the head member. A punching pin adjusting mechanism is capable of adjusting the punching pin, which extends from the face of the punch member, to a plurality of extensions from the face in accordance with requirements of the metal to be punched.

The locking hole punch can be placed in a locked mode beyond the maximum power line. This position signals the completion of the punching operation. A toggle release mechanism connected to the second lever is capable of being operated by the user to release the hole punch from the locked mode.

BRIEF DESCRIPTION OF THE DRAWINGS

My invention will be more clearly understood from the following description of specific embodiments of the invention together with the accompanying drawings wherein.

DESCRIPTIONS OF THE PREFERRED EMBODIMENT

Reference is now made in detail to the drawings wherein the same or similar elements are referred to by the same numerals throughout.

Figure 1:
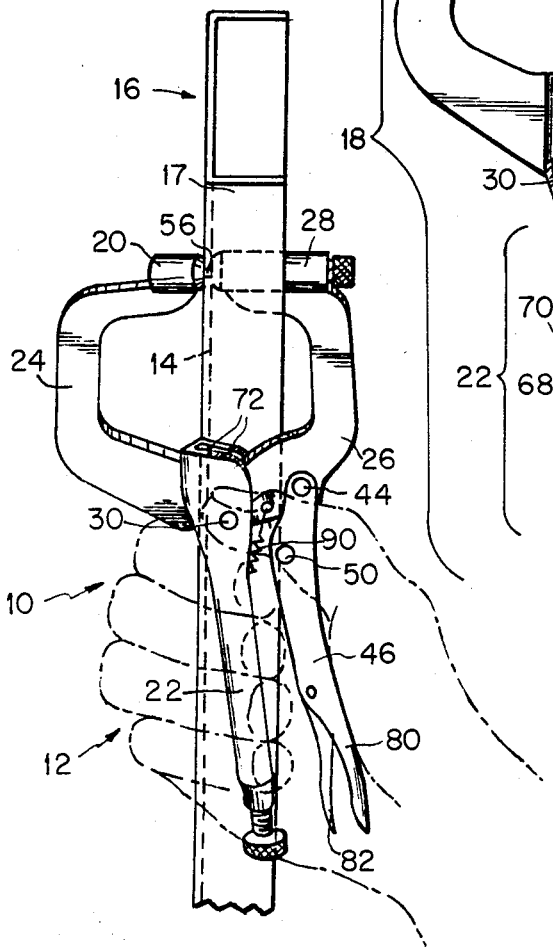
FIG. 1 is a side elevational view of the hand tool being used to punch a hole in a metal C-shaped stud.
Figure 2:
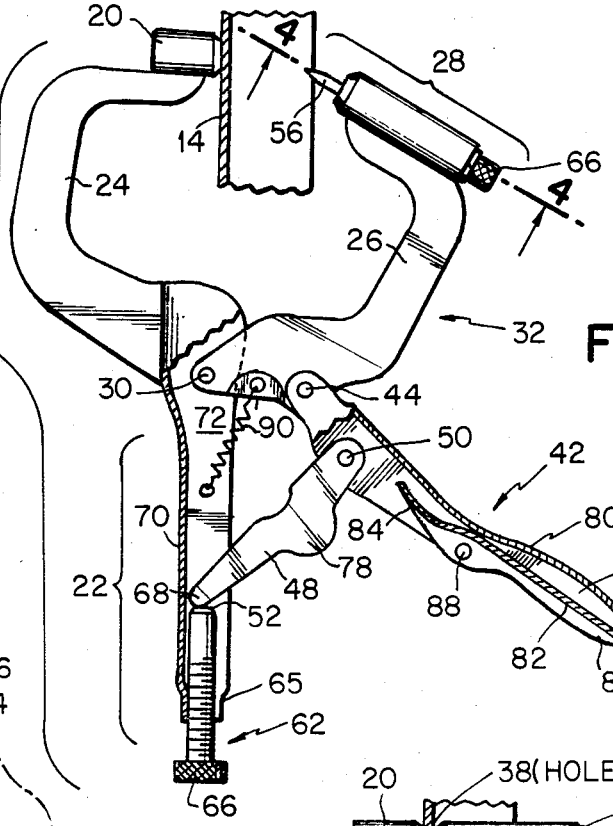
FIG. 2 is a partly sectioned side view of the hand tool in an open position.
Figure 3:
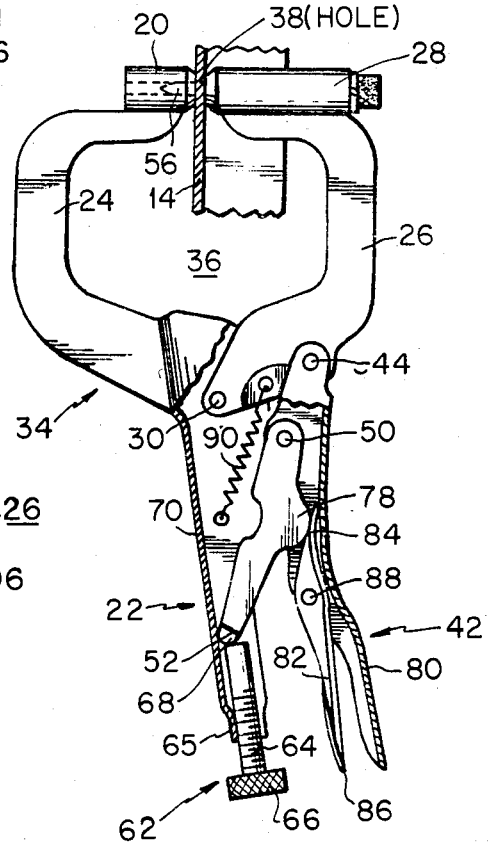
FIG. 3 is a partly sectioned side view of the hand tool in a closed position.

A locking hole punch 10 shown in FIG. 1 is being gripped by a hand 12 of a user to punch a hole in the central metal sheet portion 14 of a metal C-shaped stud 16 that includes a pair of side walls 17 connected to sheet 14. FIG. 2 shows the locking hole punch in preparation to punch the hole in sheet 14; and FIG. 3 shows the locking hole punch having punched the hole in sheet 14.

Locking hole punch 10 includes an arm member 18 having a head member 20 at one end and a straight, elongated handle portion 22 at the other end with a C-shaped portion 24 between head member 20 and handle 22. The system further includes a first lever member 26 which is C-shaped in configuration and includes a punch member 28 at one end and is pivotably mounted by a pivot pin at the other end to arm 18 at a first pivot 30 located between C-shaped portion 24 and handle 22. First lever 26 and arm 18 are pivotably movable about first pivot 30 between open and closed, or working, positions 32 and 34, respectively, as shown in FIGS. 2 and 3, respectively. In open position 32 punch 28 is spaced from head 20; and in working position 34 punch 28 is in operative relationship with head 20 and C-shaped portion 24 and C-shaped first lever 26 from a closed, generally double-C-shaped aperture 36. Double-C-shaped aperture 36 allows head 20 and punch 28 to come into operative relationship about side walls 17 of stud 16. Punch 28 is for punching a hole 38 (FIG. 5) in sheet 14 when the sheet is positioned between punch 28 and head 20.

The locking hole punch includes a second lever member 42 having one end pivotably mounted by a pivot pin to first lever 26 at a second pivot 44 spaced from first pivot 30 and an opposed handle end 46. Second lever 26 is adapted to be hand held handle end 46. Second lever 26 is adapted to be hand held together with handle 22 of arm 18.

The locking hole punch also includes a third lever, or toggle, member 48 having opposite ends pivotably mounted to second lever 42 at one end of a third pivot 50 by a pivot pin and pivotably mounted to handle 22 of arm 18 at the opposite end by a fourth pivot 52 in a manner to be described. Second lever 42 is adapted to drive first lever 26 at a second pivot 44 about third pivot 50 from open position 32 to working position 34. Toggle member 48 is adapted to be aligned with third and fourth pivots 50 and 52 with second pivot 44 when first lever 26 is in closed working position 34.

Punch member 28 includes a punch face 34 generally opposite head 20 and a punching pin 56 extending outwardly from face 54. Head member 20 forms a bore 60 adapted to receive pin 56 when first lever 26 is in working position 34.

A toggle adjusting device 62 positioned at one end of handle 22 of arm 18 is adapted to move the location of fourth pivot 32 to a plurality of selected positions relative to first pivot 30. Toggle adjusting device 62 includes a screw member 64 having opposed inner and outer ends, the inner end being in pressure contact with toggle member 48 and having a cylindrical gripping member 66 at the opposite end positioned external to the endmost portion of handle 22. Screw 64 is threadably mounted to mating threads at cylindrical end 65 of handle 22 so that screw 64 is threadably movable in the longitudinal dimension within handle 22 by manual rotation of gripping member 66 to a selected position. Toggle member 48 is capable of being rotated against the inner end of screw member 64 during both manipulation of screw 64 during toggle adjustment operation and during general operation of the hand tool 10. Handle 22 includes a wall 70 which forms both cylindrical end 65 and the remainder, which is U-shaped in cross-section having the base of the U disposed outwardly and the aperture of the U facing second pivot 44 and toggle member 48. A gripping finger 68 extends from the fourth pivot end of toggle member 48 between wall 70 of arm 18 so that toggle member 48 is held in position relative to arm 18 and screw 48 at all times. In addition, toggle member 48 is provided with a double flange 72 that is wider across the double flange than the width of the aperture of the U of wall 70 so that toggle member 48 is held in position relative to arm 18 at all times. For purposes of assembly and maintenance, the aperture of the U of wall 70 widens nearer to first pivot 30 so that toggle member 48 can be assembled to and removed from arm 18. As a result, fourth pivot 52, which is the pressure juncture between toggle member 48 and the inner end of screw 64, is movable longitudinally along handle 22.

Figure 6:
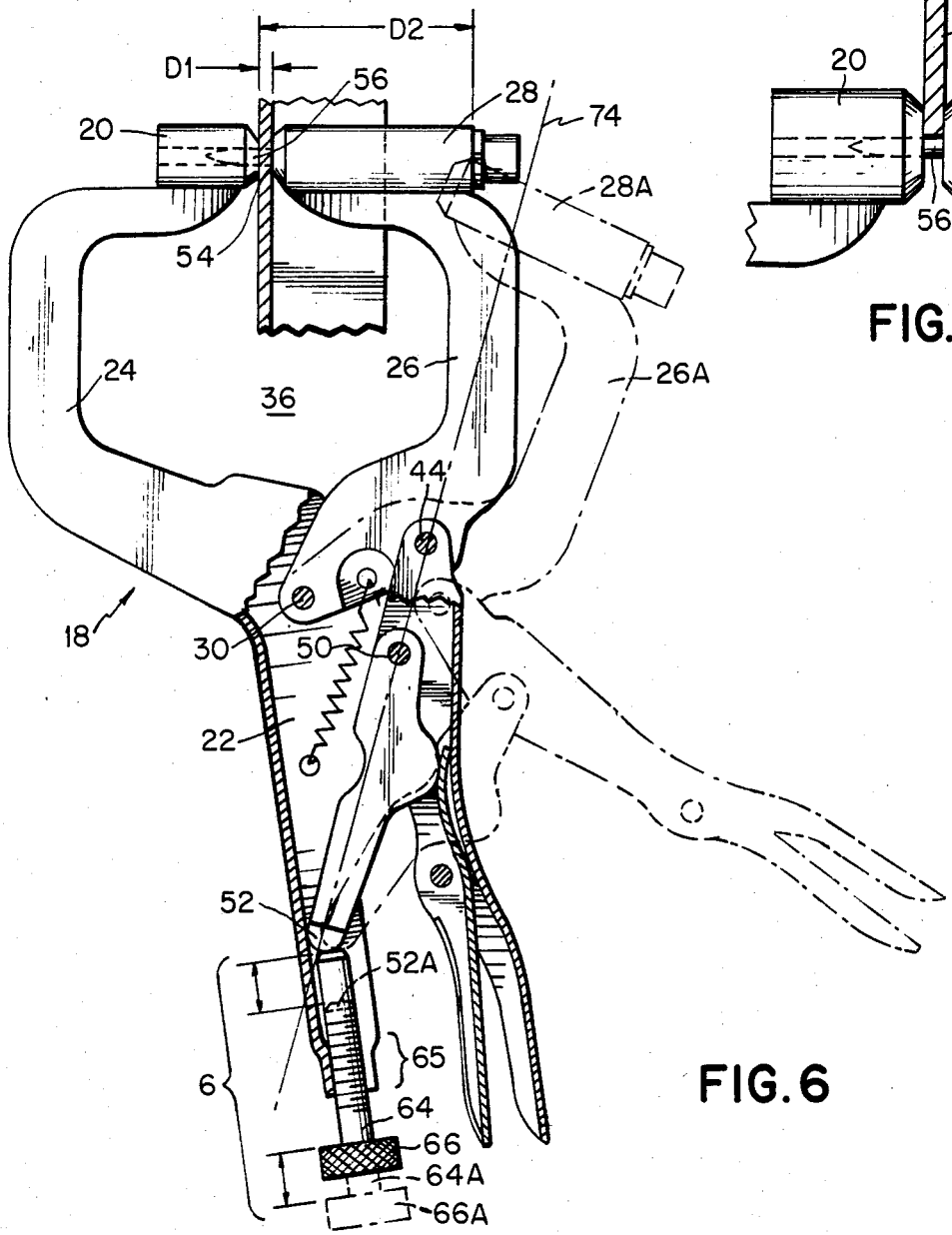
FIG. 6 is a side view of the hand tool showing toggle adjusting means in two positions with the toggle in full working alignment in each position.

As seen best in FIG. 6, second lever 42 is adapted to lever first lever 26 at third pivot 50 into the working position upon manual pressure drawing second lever 42 and handle portion 22 together, with toggle member 48 acting as the fulcrum. The working position is such that third pivot 50 in effect is levered into alignment with second pivot 44 and fourth pivot 52 along a power line 74.

Figure 7:
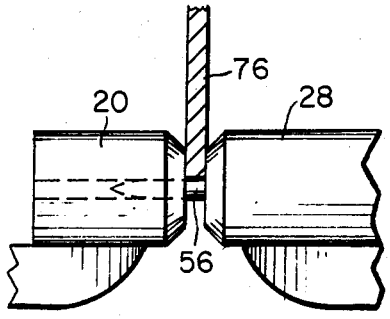
FIG. 7 is a detailed view of the head and punch being aligned with the thickness of a selected metal sheet.

FIG. 6 also illustrates the result of operation of toggle adjusting device 62. Power line 74 is shown with second pivot 44, third pivot 50, and fourth pivot 52 in alignment with head 20 and face 54 closely spaced apart from one another at a distance $D_1$. For purposes of exposition screw 64 has been lowered a relatively considerable distance to a new position shown by screw 64A so that the second, third, and fourth pivots, shown as 44A, 50A, and 52A, respectively, form a new power line 74A so that head 20 and the punch face, shown as 54A, are spaced apart at a greater distance $D_2$ than $D_1$. It is to be understood that the position of maximum drive of punch 28 relative to head 28 is the power line, whether 74 or 74A. The thickness of the particular sheet to be punched is the determining factor the distance between head 20 and punch face 54 as determined by power line 74. Obviously, distance $D_2$ is much greater than the thickness of any sheet to be punched, since FIG. 6 is intended to illustrate the principle only. FIG. 7 illustrates an ideal case when the thickness of a sheet 76 can be gripped between head 20 and punch face 54. Toggle adjusting device 62 is operated so that the power line is set at the distance between the head and the punch face as determined by the sheet thickness. Generally, however, the sheet might not be able to be gripped in setting the power line, and the usual method of preparing the locking hole punch 10 for operation would be by trial and error. In addition, the thickness of sheet 76 is one of other possible factors in adjusting toggle member 62; such factors can include the material of the sheet, the distance pin 56 extends from punch face 54, and the shape of pin 56.

Toggle member 48 will be moved from the working position just discussed into a togglr locking position upon the application of further pressure against arm 18 and second lever 42 so that third pivot 50 will be shifted slightly past power line 74 toward arm 18 so that the entire system including arm 18 with head 20 and first lever 26 are in a locked mode. This position is indicated in FIG. 6 by the position of third pivot shown as 50B so that the former straight line 74 is broken and must be penetrated by third pivot 50 from its position at 50B before release of the system is accomplished. Movement into the toggle locking position is stopped at the position shown by a locking shoulder 78 extending from the middle area of toggle member 48 which presses against second lever 42. In particular, second lever 42 includes a U-shaped wall 80 having the longitudinal aperture of the U in cross-section facing arm 18 and the base of the U disposed along the outer portion of the second lever. Shoulder 78 is adapted to be in pressure contact with the inner surface of the base of wall 80 when toggle member 48 has reached the toggle locking position.

Toggle member 48 is released from the toggle locking position by a toggle release mechanism that includes a toggle release bar 82 disposed within the elongated U of wall 80 and having opposed clamping and release ends 84 and 86, respectively. Release bar 82 is rotatably connected to second lever 42 by a pivot pin 88 at the base of the U of wall 80. Clamping end 84 is adapted to receive shoulder 78 when toggle member 48 has reached the toggle locking position. Release bar 82 is rotatably movable between first and second positions. In the first position clamping end 84 is spaced from second lever 42 and release end 86 is proximate to second lever 42. In the second position clamping end 84 is pressed to second lever 42 by shoulder 78, and release end 86 is spaced from second lever 42. Toggle locking member 48 is in the toggle nonlocking position when release bar 82 is in the first position, and is in the toggle locking position when release bar 42 is in the second position. Release end 86 is adpated to be manually pressured from the second position to the first position in order to move toggle member 48 from the toggle locking position to the toggle nonlocking position. The movement of release end 86 from. the first position drives second lever 42 about second pivot 44 at clamping end 84 against shoulder 78 and drives third pivot 50 at least to power line 74.

An extension spring 90 is connected to handle 22 proximate fourth pivot 52 at one end and to first lever 26 between first pivot 30 and second pivot 44. Spring 90 moves from an unbiased mode in the open position of the tool to a biased mode when the tool is in the working position, so that when the tool is aligned along power line 74, the tool is being biased back into the open position. Spring 90 is generally parallel to toggle member 48 when toggle member is in the toggle locking position so that spring 90 does not drive the tool from the toggle locking position to the toggle nonlocking position.

Figure 4:
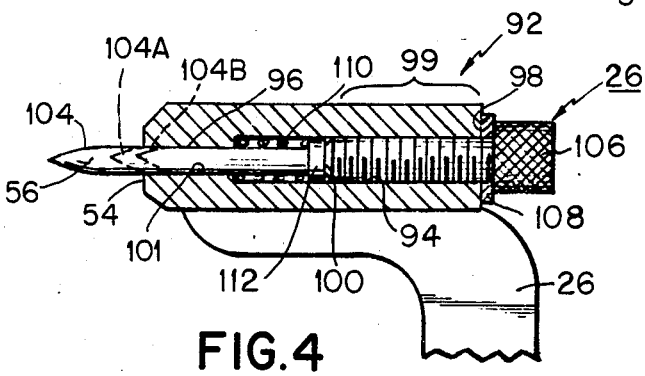
FIG. 4 is a sectioned view of the punch with a pin adjusting feature.
Figure 5:
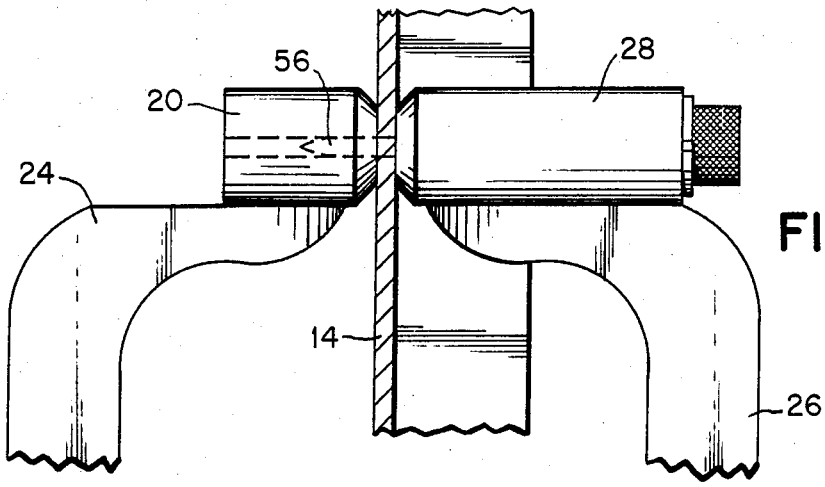
FIG. 5 is a detailed sectioned view of the punch and head with the punching pin shown having punched a hole in metal sheet.

As seen in FIG. 4, which shows punching pin 56 having punched hole 38 in sheet 14, a punching pin adjusting means 92 capable of moving punching pin 56 to a plurality of selected positions relative to head member 20 includes punch member 28 forming an elongated hole 94 having opposed inner and outer openings 96 and 98, respectively, relative to head member 20 and forming internal threads 99 between outer opening 98 and a position 100 spaced from inner opening 96. Head member 20 forms a pinched aperture 101 at face 54 so that pin 56, which is slidably mounted in pinched aperture 101, is held in a firm position. Punching pin 56 has a pointed end 104 adapted to punch a hole in sheet 14 and an opposed base end positioned in elongated hole 94. A screw member 102 having an interior end in pressure contact with inner pin is threadably mounted with threads 99 in elongated hole 94. A cylindrical handle 106 is connected to the other end of screw 102, which is disposed external of outer opening 98. A washer 108 is positioned between handle 106 and outer opening 98 of punch 28. As seen in FIG. 4, pointed end 104 has been positioned at its maximum extension by screw 102. Rotation of handle 106 will cause screw 102 to unthread from hole 94 and so release pin 56 from its maximum extension so that a plurality of pin points indicated by points 104B and 104B are achieved. An optional helical expansion spring fitted over the interior of pin 56 and positioned in hole 94 creates biased pressure between a cylindrical head 112 at the interior end of pin 56 opposite point 104 and the pinched nose 114 of punch member 28 at inner opening 96 of hole 94. The interior of pin 56 is thus always pressed against the interior end of screw 102. Punching pin adjusting means 92 is capable of adjusting the working length of punching pin 56 to a range of varying thickness of sheets to be punching. Punching pin 56 is shown in FIG. 5 having completed a punching operation with hole 38 in sheet 14 completed. A slight metal accumulation 114 on the head side of the sheet can be of aid when mounting screws are later attached to the sheet, for accumulation 114 can act as a locking washer when the holding nut is put on the mounting screw.

Although the present invention has been described in some detail by way of illustration and example for purposes of clarity and understanding, it will, of course, be understood that various changes and modifications may be made with the form, details, and arrangements of the parts without departing from the scope of the invention as set forth in the following claims.

I claim:

1. A locking hole punch for punching holes through a sheet comprising:

(a) An arm having head means at one end and a handle portion at the other end and an outwardly curved portion between the head and handle portions;

(b) a first lever outwardly curved in configuration and having adjustable punch means at one end with an operating axis transverse to the axis of the handle portion, said punch means including punching pin adjusting means for moving the punching pin relative to the opposing head, pivotably mounted at the other end to the arm at a pivot between the handle portion and its outwardly curved portion, said first lever and said arm pivotably movable about the first pivot between open and working positions, so that in the open position the adjustable punch means is spaced from the head means, and in the working position the punch means cooperates with the head means and said outwardly curved portion and said outwardly curved lever form a closed perimeter, whereby said punch means and said head means can punch a hole in a sheet interposed between them;

(c) a second lever pivotably mounted at one end at a second pivot point spaced from the first pivot on the first lever and having a handle end, said second lever spaced from the handle portion of the arm in the open position and in hand-gripping relation to the arm in the closed position;

(d) toggle means pivotably mounted to the second lever at a third pivot and to the handle portion of the arm member at a fourth pivot point, said second lever adapted to drive the first lever rotatably at the second pivot about said first pivot from the open position to a working punching position when the second lever is driven toward the arm, said toggle means and said second, third, and fourth pivots so aligned to form a power line when the first lever is in the working position; and (e) biasing means connected between the handle portion of the arm and the first lever for returning the first lever and the second lever from the working position to the open position.

2. A locking hole punch as in claim 1, wherein the adjustable punch means includes a punch member having an inwardly extending punching pin, and said head means includes a head member containing a bore adapted to receive said pin when the first lever is in the working position.

3. A locking hole punch as in claim 2, wherein the fourth pivot is adjustable along the arm member and includes toggle adjusting means on the handle portion of the arm for moving the position of the fourth pivot along the handle portion, whereby the working position of the punching pin may be locked.

4. A locking hole punch as in claim 3, wherein said toggle adjusting means includes a toggle member having one end at said third pivot and the other end at said fourth pivot; said toggle adjusting means further including said handle member having a handle end opposite said outwardly curved portion; and a screw member having opposed inner and outer ends, said outer end having a cylindrical gripping member positioned external to the endmost portion of said handle end, said inner end and said toggle member being in pressure contact at a juncture whereat said toggle member is rotatably movable relative to said handle portion at said juncture, said juncture comprising said fourth pivot, said screw member being threadably mounted in said handle end so that said screw member is movable to a plurality of selected positions in the longitudinal dimension by rotating said gripping member, whereby said fourth pivot is capable of being moved to a plurality of locations along said handle portion.

5. A locking hole punch as in claim 4, wherein said second lever member is adapted to drive said first lever member and said third pivot into the working position with said toggle member as the fulcrum, said working position being whereat said third pivot is aligned on a power line with said second and fourth pivots.

6. A locking hole punch as in claim 1, wherein the toggle means includes a locking shoulder adapted to press against the second level when said toggle means has reached its toggle locking position.

7. A locking hole punch as in claim 6, further comprising toggle release means mounted on the second lever at the handle portion of said lever and rotatably connected to said second lever, whereby moving the toggle release means actuates the toggle means to release the locking hole punch from the locked working position.

8. A locking hole punch as in claim 7, wherein said toggle release means includes a toggle release bar having opposed clamping and release ends rotatably connected to said second lever, said clamping end adapted to receive said locking shoulder of said toggle member when said toggle member is in said toggle locking position, said toggle release bar being rotably movable between first and second positions, where at in said first position said clamping end is spaced from said second lever and said release end is proximate to said second lever, and in said second position said clamping end is pressed to said second lever by said shoulder of said toggle member and said release end is spaced from said second lever, said toggle member being in said toggle nonlocking position when said toggle release bar is in said first position and being in said locking position when said toggle release bar is in said second position, said release end adapted to be manually pressured from said second position to said first position to move said release end from said second position to said first position and thereby move said toggle member from said toggle locking position to said toggle nonlocking position.

9. A locking hole punch as in claim 1, wherein the sheet is that of a metal C-shaped stud.

10. A locking hole punch as in claim 1, wherein said first, second, and third pivots include pivot pins.

11. A locking hole punch as in claim 4, wherein the fourth pivot includes the other end of the toggle member and the inner end of the screw makes pressure contact at a juncture, said toggle member movable by the screw member at said fourth pivot.

12. A locking hole punch as in claim 1, wherein the outwardly curved portion of the arm and the outwardly curved first lever are both C-shaped, so that in the working position a double C-shaped closed frame is formed.

13. A locking hole punch as in claim 1, wherein the punching pin adjusting means comprises a punch head containing an internally threaded bore, a punching pin adapted to be moved along the axis of the threaded bore, an externally threaded member adapted to position the punching pin within the threaded bore of the punch head, and an adjusting knob at the end of the externally threaded member opposite to the punching pin to adjust the position of the punching pin relative to the head means of the arm.

* * * * *